US005869936A

United States Patent [19]

Horinishi et al.

[11] Patent Number: 5,869,936

[45] Date of Patent: Feb. 9, 1999

[54] STROBE DEVICE

[75] Inventors: Katsumi Horinishi, Hashimoto; Takanaru Kobayashi, Osaka, both of Japan

[73] Assignee: West Electric Company, Ltd., Osaka, Japan

[21] Appl. No.: 901,918

[22] Filed: Jul. 29, 1997

[51] Int. Cl.[6] ..... H05B 37/00

[52] U.S. Cl. ..... 315/241 S; 315/241 R; 315/241 P; 315/245

[58] Field of Search ..... 315/241 S, 241 R, 315/241 P, 240, 245, 219, 225

[56] References Cited

U.S. PATENT DOCUMENTS

| | | | |
|---|---|---|---|
| 4,697,906 | 10/1987 | Kobayashi et al. | 315/241 P X |
| 5,180,953 | 1/1993 | Hirata et al. | 315/241 |
| 5,250,977 | 10/1993 | Tanaka | 315/241 P X |

*Primary Examiner*—Hoanganh Le
*Assistant Examiner*—Haissa Philogene
*Attorney, Agent, or Firm*—Renner, Otto, Boisselle & Sklar, P.L.L.

[57] ABSTRACT

A strobe device according to the present invention includes: a main capacitor; and step-up means including at least one step-up capacitor, the at least one step-up capacitor being rapidly charged via a flash discharge tube in an ionization state, a charged voltage of the at least one step-up capacitor being superimposed on a charged voltage of the main capacitor and applied across the flash discharge tube at least via an insulated gate bipolar transistor and a restriction resistor coupled in series with the flash discharge tube. The resistance value of the restriction resistor is prescribed to satisfy both of the following two conditions:

(1) during an OFF state of the insulated gate bipolar transistor, an electric current flowing via the flash discharge tube is controlled at a level where the flash discharge tube cannot continue to discharge; and (2) during an ON state of the insulated gate bipolar transistor, a voltage across the flash discharge tube is stepped up to a voltage which is higher than the charged voltage of the main capacitor when the charged voltage of the step-up capacitor is applied across the flash discharge tube.

9 Claims, 5 Drawing Sheets

PRIOR ART

STROBE DEVICE

BACKGROUND OF THE INVENTION

1. FIELD OF THE INVENTION

The present invention relates to a strobe device including an insulated gate bipolar transistor (hereinafter referred to as "IGBT") connected in series with a flash discharge tube for controlling the luminous operation of the flash discharge tube. In particular, the present invention relates to a strobe device having an improved voltage supply section for supplying a voltage to the flash discharge tube, thereby providing an advantage in the case where the flash discharge tube repeats luminous emissions at a high speed, for example.

2. DESCRIPTION OF THE RELATED ART

A variety of strobe devices including an IGBT connected in series with a flash discharge tube for controlling the luminous operation of the flash discharge tube have been proposed or implemented.

Well-known conventional strobe devices incorporating an SCR as an element for controlling the luminous operation require a terminating structure. In contrast, the above strobe device incorporating an IGBT does not require any terminating structure in the circuitry thereof. Therefore, such a strobe device prevents overflash problems and stably enables repetitive luminous operations at a high cycle. Consequently, this type of strobe device has been regarded as especially useful in recent years.

A strobe device is also known which includes a step-up means, i.e., a means for stepping up the voltage across a flash discharge tube by applying a predetermined voltage across the flash discharge tube in synchronization with an operation for starting the luminous emission (hereinafter referred to as a "start operation"), the predetermined voltage being higher than the charged voltage of a main capacitor. The step-up means is incorporated, in addition to a known trigger structure, as an auxiliary means for starting the luminous operation of the flash discharge tube. Such a step-up means is conveniently incorporated also in the aforementioned strobe device having an IGBT.

FIGS. 6A and 6B show exemplary strobe devices incorporating a step-up means as described above, which was previously proposed by the Applicant in U.S. Pat. No. 5,180,953. FIG. 6A shows an essential portion of the circuitry of an exemplary IGBT-type strobe device configured so that a voltage more than about twice as high as the charged voltage of a main capacitor 2 is constantly applied across e flash discharge tube 3 during a start operation of the flash discharge tube 3. Similarly, FIG. 6B shows an essential portion of the circuitry of an exemplary IGBT type strobe device configured so that a voltage about three times as high as the charged voltage of a main capacitor 2 is constantly applied across a flash discharge tube 3 during a start operation of the flash discharge tube 3.

In each of the strobe devices shown in FIGS. 6A and 6B, the main capacitor 2 is coupled between output terminals of a DC high voltage power supply 1 (which may be composed of a known DC-DC convertor or a multilayer power supply) for charging the main capacitor 2.

Across the main capacitor 2 in FIG. 6A, the flash discharge tube 3, a first diode 4, and an IGBT 5 are connected in series. A resistor 6, a transistor 7, and a second diode 8 are connected in series across serially connected elements including the first diode 4 and the IGBT 5. The transistor 7 includes a base as a control terminal for the transistor 7 functioning as a switch.

A multiplying capacitor 9 is connected between a junction X (between the first diode 4 and the IGBT 5) and a junction Y (between the transistor 7 and the second diode 8). Resistors 10 and 11 are connected in series across the second diode 8. A Junction between the resistors 10 and 11 is connected to the base (i.e., control terminal) of the transistor 7. Between a higher-potential terminal of the main capacitor 2 and the junction X, a resistor 12 may be connected, for example; the resistor 12 and the second diode 8 form a charge circuit for charging the multiplying capacitor 9 so as to provide a higher potential at the junction X. Across the IGBT 5, a known trigger circuit 15 for exciting the flash discharge tube 3 is connected, the trigger circuit 15 including a trigger capacitor 13 and a trigger transformer 14.

An emission control circuit 16 coupled to the gate of the IGBT 5 controls the supply of an ON voltage to the gate of the IGBT 5, thereby turning the IGBT 5 on or off. Thus, the emission control circuit 16 controls the luminous operation of the flash discharge tube 3.

Turning to the exemplary IGBT type strobe device shown in FIG. 6B, the flash discharge tube 3, a plurality of diodes 17 and 18, and the IGBT 5 are connected in series across the main capacitor 2.

A set of serially connected elements including transistor 19 and step-up capacitor 21, and a set of serially connected elements including transistor 20 and step-up capacitor 22 are connected between an anode and a cathode of each of the plurality of diodes 17 and 18, respectively. Furthermore, a diode 23 for preventing a reverse current is connected between an emitter of the IGBT 5 (shown to be grounded in the figure) and a junction between the transistor 19 and the step-up capacitor 21. Similarly, a diode 24 for preventing a reverse current is connected between the emitter of the IGBT 5 and a junction between the transistor 20 and the step-up capacitor 22.

Resistors 25 and 27 are connected between the emitter of the IGBT 5 and the base of the transistor 19; resistors 26 and 27 are connected between the emitter of the IGBT 5 and the base of the transistor 20. A resistor 28 is connected between the base and the emitter of the transistor 19; and a resistor 29 is connected between the base and the emitter of the transistor 20.

Across the flesh discharge tube 3, a resistor 12 may be connected, for example; the resistor 12 and the diode 23 or 24 form a charge circuit for charging the step-up capacitor 21 or 22 so that a higher potential is provided at its terminal coupled to the collector of the IGBT 5.

As in the exemplary IGBT type strobe device shown in FIG. 6A, a known trigger circuit 15 for exciting the flash discharge tube 3 is connected across the IGBT 5. An emission control circuit 16 is coupled to the gate of the IGBT 5 for controlling the supply of an ON voltage to the gate of the IGBT 5 so as to turn the IGBT 5 on or off, thereby controlling the luminous operation of the flash discharge tube 3.

Thus, in accordance with the device of either FIG. 6A or 6B, as the DC high voltage power supply 1 starts operating, the main capacitor 2, the multiplying capacitor 9, the trigger capacitor 13, and the step-up capacitors 21 and 22 are charged so as to have the polarities as shown in FIG. 6A or 6B, respectively.

When the emission control circuit 16 turns on the IGBT 5 after the main capacitor 2 is charged, the trigger circuit 15 operates to excite the flash discharge tube 3. At the same time, in the strobe device of FIG. 6A, the electricity charged in the multiplying capacitor 9 is discharged via the IGBT 5 and the resistors 10 and 11. As a result, the transistor 7 is turned on due to a drop in the voltage across the resistor 10.

In the strobe device of FIG. 6B, the electricity charged in the step-up capacitors 21 and 22 is discharged via the path including the IGBT 5 and the resistors 27, 25, and 28, and via the path including the IGBT 5 and the resistors 27, 26, and 29, respectively. As a result, the transistors 19 and 20 are turned on due to a drop in the voltage across the resistors 28 and 29, respectively.

As a result, in the strobe device of FIG. 6A, the charged voltage of the multiplying capacitor 9 is applied across the flash discharge tube 3 via a loop including the IGST 5, the main capacitor 2, and the transistor 7. Thus, a superimposed voltage of the main capacitor 2 and the multiplying capacitor 9, which is about twice as high as the charged voltage of main capacitor 2, is applied across the flash discharge tube 3.

In the strobe device of FIG. 6B, the charged voltages of the step-up capacitors 21 and 22 are applied across the flash discharge tube 3 via a loop including the IGBT 5, the main capacitor 2, and the transistors 19 and 20. Thus, a superimposed voltage of the main capacitor 2 and the multiplying capacitors 21 and 22, which is about three times as high as the charged voltage of the main capacitor 2, is applied across the flash discharge tube 3.

Therefore, in either case, the flash discharge tube 3 begins to consume the charged electricity of the main capacitor 2 as the IGBT 5 is turned on. Thus, the flash discharge tube 3 easily flashes.

If the IGBT 5 is turned off by the emission control circuit 16 at an appropriate point of time during the emission of the flash discharge tube 3, the discharge loop including the main capacitor 2 and the like via the IGBT 5 is disrupted, in accordance with the strobe device of either FIG. 6A or 6B. As the flash discharge tube 3 consequently stops luminous emission, the flash discharge tube 3 experiences an ionization state where its cathode potential becomes high, and eventually returns to a normal state, as is well known to those skilled in the art. At the same time, the multiplying capacitor 9 and the like are placed in a state for enabling charging.

Thus, in the strobe device of FIG. 6A, a current flows in a loop including the main capacitor 2, the flash discharge tube 3, the multiplying capacitor 9, and the second diode 8; and a loop including the main capacitor 2, the flash discharge tube 3, the trigger capacitor 13, and the trigger transformer 14.

In the strobe device of FIG. 6B, a current flows in a loop including the main capacitor 2, the flash discharge tube 3, the step-up capacitor 21, and the reverse current-prevention diode 23; a loop including the main capacitor 2, the flash discharge tube 3, the step-up capacitor 22, and the reverse current-prevention diode 24; and a loop including the main capacitor 2, the flash discharge tube 3, the trigger capacitor 13, and the trigger transformer 14.

As a result, the multiplying capacitor 9, the step-up capacitors 21 and 22 and the trigger transformer 13 are charged instantaneously.

Thus, it is ensured that the charged voltage across the multiplying capacitor 9 or the step-up capacitors 21 and 22 is applied again across the flash discharge tube 3 when the IGBT 5 is turned on for a next luminous operation.

As described above, the strobe device shown in FIG. 6A or 6B includes the multiplying capacitor 9 or the step-up capacitors 21 and 22 capable of rapid charging as the flash discharge tube 3 enters an ionization state. As a result, a predetermined function of increasing the voltage across the flash discharge tube 3 is performed each time by applying the charged voltage of the multiplying capacitor 9 or the step-up capacitors 21 and 22 across the flash discharge tube 3 when the IGBT 5 is turned on. Thus, the flash discharge tube 3 can flash in time each time the IGBT 5 is turned on, even in a high frequency cycle.

However, the above-mentioned advantage of the strobe devices shown in FIGS. 6A and 6B requires a number of elements incorporated corresponding to the multiplying capacitor 9, and the step-up capacitors 21 and 22.

In other words, a set of elements are required for each multiplying capacitor 9 or step-up capacitor 21, etc., each set including the transistors 7, 19 and 20; and the set of resistors 6, 10, 11, and the set of resistors 25 to 29 for controlling the operations of the transistors 7, 19 and 20. As a result, the total number of elements required for the strobe device of FIG. 6A or 6B becomes rather large, with correspondingly larger space and higher cost being required.

For example, the transistor 7 in FIG. 6A and the transistor 19 in FIG. 6B thus coupled are required to withstand a high voltage, and also require the resistors 10, 25, and the like for operation. Such are the burden on the space and cost of the above-described conventional strobe device.

SUMMARY OF THE INVENTION

A strobe device according to the present invention includes: a main capacitor; and step-up means including at least one step-up capacitor, the at least one step-up capacitor being rapidly charged via a flash discharge tube in an ionization state, a charged voltage of the at least one step-up capacitor being superimposed on a charged voltage of the main capacitor and applied across the flash discharge tube at least via an insulated gate bipolar transistor and a restriction resistor coupled in series with the flash discharge tube. The resistance value of the restriction resistor is prescribed to satisfy both of the following two conditions: (1) during an OFF state of the insulated gate bipolar transistor, an electric current flowing via the flash discharge tube is controlled at a level where the flash discharge tube cannot continue to discharge; and (2) during an ON state of the insulated gate bipolar transistor, a voltage across the flash discharge tube is stepped up to a voltage which is higher than the charged voltage of the main capacitor when the charged voltage of the step-up capacitor is applied across the flash discharge tube.

In one embodiment of the invention, a charged voltage of the at least one step-up capacitor is superimposed on the charged voltage of the main capacitor and applied across the flash discharge tube via no other switch element than the insulated gate bipolar transistor.

In another embodiment of the invention, a charged voltage of the at least one step-up capacitor is superimposed on the charged voltage of the main capacitor and applied across the flash discharge tube via a control switch element as well as the insulated gate bipolar transistor and the restriction resistor.

In another embodiment of the invention, the step-up means includes n step-up capacitors (where n is an integer), charged voltages of the n step-up capacitors being superimposed on the charged voltage of the main capacitor and applied across the flash discharge tube via (n−1) control switch elements as well as the insulated gate bipolar transistor and the restriction resistor, each of the (n−1) control switch elements being provided in a loop dedicated for the application of the charged voltages across the flash discharge tube.

Alternatively, the strobe device according to the present invention includes: a main capacitor; first serially connected elements including a flash discharge tube, a diode, and an insulated gate bipolar transistor connected in series with one another, the first serially connected elements being coupled across the main capacitor, a luminous operation of the flash discharge tube being controlled responsive to the turning on and off of the insulated gate bipolar transistor, and an anode of the diode being coupled to a cathode of the flash discharge tube; and step-up means. The step-up means includes: second serially connected elements including a step-up capacitor and a reverse current-prevention diode connected in series with one another, the second serially connected elements being coupled across the insulated gate bipolar transistor; a restriction resistor having one end coupled to the anode of the diode and another end coupled to a junction between the step-up capacitor and the reverse current-prevention diode, whereby the restriction resistor is coupled to the cathode of the diode via the step-up capacitor; and a charge path coupled in parallel to serially connected elements including the flash discharge tube and the diode, the charge path and the reverse current-prevention diode forming a charge circuit for charging the step-up capacitor so that a higher potential is provided at an end of the step-up capacitor coupled to the diode. The resistance value of the restriction resistor is prescribed to satisfy both of the following two conditions: (1) during an OFF state of the insulated gate bipolar transistor for stopping the luminous operation of the flash discharge tube, an electric current flowing in a loop including the flash discharge tube, the restriction resistor, and the reverse current-prevention diode is controlled at a level where the flash discharge tube cannot continue to discharge; and (2) during an ON state of the insulated gate bipolar transistor, a voltage across the flash discharge tube is stepped up to a voltage which is higher than the charged voltage of the main capacitor when the charged voltage of the step-up capacitor is applied across the flash discharge tube, whereby the step-up means rapidly charges the step-up capacitor via the flash discharge tube in an ionization state and the reverse current-prevention diode, and applies the charged voltage of the step-up capacitor across the flash discharge tube via the restriction resistor.

In one embodiment of the invention, the step-up means includes: a control element coupled between the diode and the insulated gate bipolar transistor; and a control diode coupled in parallel to serially connected elements including the diode and the control element.

Alternatively, the strobe device according to the present invention includes: a main capacitor; first serially connected elements including a flash discharge tube, a plurality of diodes, and an insulated gate bipolar transistor connected in series with one another, the first serially connected elements being coupled across the main capacitor, a luminous operation of the flash discharge tube being controlled responsive to the turning on and off of the insulated gate bipolar transistor, an anode of a first one of the plurality of diodes being coupled to a cathode of the flash discharge tube; and step-up means. The step-up means includes; third serially connected elements including a restriction resistor and a first step-up capacitor connected in series with each other, the restriction resistor having one end coupled to the anode of the first one of the plurality of diodes and another end coupled to a cathode of the first one of the plurality of diodes via the step-up capacitor; at least one series of serially connected elements including a switch element and a second step-up capacitor, the switch element being coupled between an anode and a cathode of each one of the plurality of diodes except the first one of the plurality of diodes; a plurality of reverse current-prevention diodes, one of the plurality of reverse current-prevention diodes being coupled between an emitter of the insulated gate bipolar transistor and a junction between the first step-up capacitor and the restriction resistor, and the others of the plurality of reverse current-prevention diodes being coupled between the emitter of the insulated gate bipolar transistor and respective junctions between the switch elements and the second step-up capacitors of the at least one series of serially connected elements; a gate circuit coupled to a control terminal of each switch element coupled to the second step-up capacitor; and a charge path coupled in parallel to serially connected elements including the flash discharge tube and the first one of the plurality of diodes, the charge path and the plurality of reverse current-prevention diodes forming a charge circuit for charging the first and second step-up capacitors so that a higher potential is provided at an end of each of the first and second step-up capacitors coupled to a corresponding one of the plurality of diodes. The resistance value of the restriction resistor is prescribed to satisfy both of the following two conditions: (1) during an OFF state of the insulated gate bipolar transistor for stopping the luminous operation of the flash discharge tube, an electric current flowing in a loop including the flash discharge tube, the restriction resistor, and the plurality of reverse currentprevention diodes is controlled at a level where the flash discharge tube cannot continue to discharge; and (2) during an ON state of the insulated gate bipolar transistor, a voltage across the flash discharge tube is stepped up to a voltage which is higher than the charged voltage of the main capacitor when the charged voltages of the first and second step-up capacitors are applied across the flash discharge tube, whereby the step-up means rapidly charges the first and second step-up capacitors via the flash discharge tube in an ionization state and the plurality of reverse current-prevention diodes, and applies the charged voltages of the first and second step-up capacitors across the flash discharge tube via the restriction resistor and the switch elements.

In one embodiment of the invention, the step-up means further includes a control diode coupled in parallel to serially connected elements including the plurality of diodes each coupled between the flash discharge tube and the insulated gate bipolar transistor.

In another embodiment of the invention, the step-up means further includes: a control switch element coupled between serially connected elements including the plurality of diodes and the insulated gate bipolar transistor, and a control diode coupled in parallel to serially connected elements including the plurality of diodes and the control switch element.

Thus, the invention described herein makes possible the advantages of (1) providing a strobe device incorporating step-up circuitry capable of rapidly charging while requiring a minimum number of elements; and (2) providing a strobe device incorporating step-up circuitry capable of rapidly charging, whose elements require minimum space so that the entire strobe device is miniaturized and produced at low cost.

These and other advantages of the present invention will become apparent to those skilled in the art upon reading and understanding the following detailed description with reference to the accompanying figures.

DESCRIPTION OF THE PREFERRED EMBODIMENTS

Hereinafter, the present invention will be described by way of examples with reference to the accompanying figures.

Figure 1:
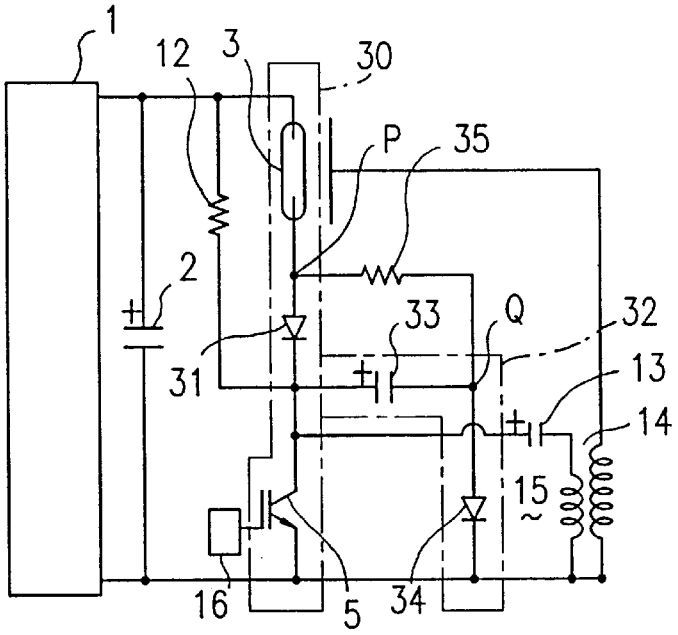
FIG. 1 is a circuit diagram showing an essential portion of a strobe device according to an example of the present invention.
Figure 6A:
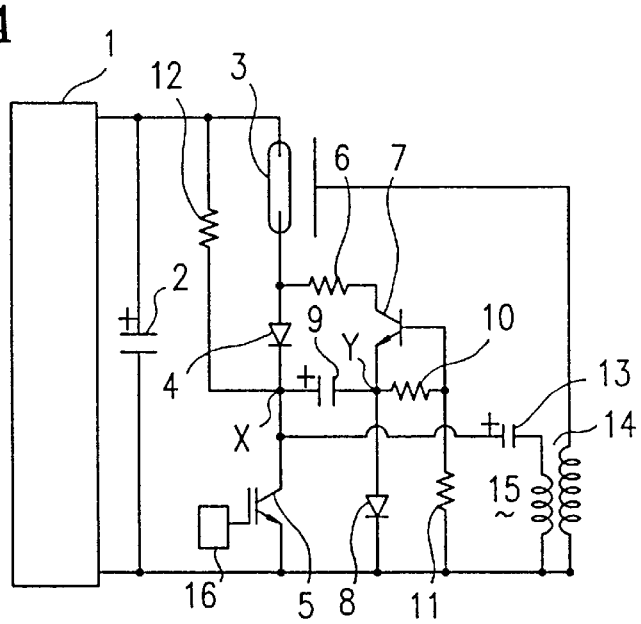
FIG. 6A is a circuit diagram showing an essential portion of a conventional strobe device disclosed in U.S. Pat. No. 5,180,953.

FIG. 1 is a circuit diagram showing an essential portion of a strobe device according to an example of the present invention. In FIG. 1, constituent elements which also appear in FIGS. 6A and 6D are indicated by like numerals.

In FIG. 1, reference numeral 30 collectively refers to first serially connected elements, which include a flash discharge tube 3, a diode 31, and an IGBT 5 connected in series with one another. The first serially connected elements are connected across a main capacitor 2. Reference numeral 32 collectively refers to second serially connected elements, which include a step-up capacitor 33 and a diode 34 for preventing a reverse current connected in series with each other. The second serially connected elements are connected across the IGBT 5. Reference numeral 35 refers to a restriction resistor which is connected between a junction P and a junction Q. The junction P defines a point at which the flash discharge tube 3 and the diode 31 are interconnected. The junction Q defines a point at which the step-up capacitor 33 and the diode 34 are interconnected.

In the strobe device of the present example illustrated in FIG. 1, the transistor 7 in the conventional strobe device shown in FIG. 6A, and the resistor 6 and the resistors 10 and 11 for controlling the transistor 7 are omitted and replaced by the resistor 35 as described below, thereby overcoming the cost/spacerelated problems associated with the transistor 7 in the conventional strobe device.

According to the present invention, the resistance value of the restriction resistor 35 is prescribed to satisfy both of the following two conditions:

(1) during an OFF state of the IGBT 5 (which stops the luminous emission of the flesh discharge tube 3), the electric current flowing through a loop including the flash discharge tube 3 in an ionization state, the restriction resistor 35, and the diode 34 must be controlled at a level such that the flash discharge tube 3 cannot continue to discharge (i.e., such that the ionization state cannot be maintained); and (2) during an ON state of the IGBT 5, the voltage across the flash discharge tube 3 must be sufficiently stepped up from the charged voltage of the main capacitor 2 alone when the charged voltage of the step-up capacitor 33 is applied across the flash discharge tube 3, so that the stepping-up function (i.e., reducing the discharge starting voltage of the flash discharge tube 3) is sufficiently achieved by the application of the charged voltage of the step-up capacitor 33 for increasing the voltage.

Before describing the operation of the strobe device of the present invention having the above structure, the advantage of omitting the transistor 7 from the strobe device will be discussed.

The significance of the transistor 7 is as follows: The transistor 7 is incorporated in order to reconcile the two operations of rapidly charging the multiplying capacitor 9 and applying the charged voltage across the flash discharge tube 3.

The operation of the multiplying circuitry of applying the charged voltage of the multiplying capacitor 9 across the flash discharge tube 3 should preferably performed with a minimum electrical loss. Therefore, it is desirable that the multiplying circuitry does not include any resistors, e.g., transistors, which may incur electrical loss in the loop for applying the charged voltage.

On the other hand, the higher-potential terminal of the multiplying capacitor 9 is coupled to the cathode of the flash discharge tube 3 via the first diode 4 so that the multiplying capacitor 9 is rapidly charged via the flash discharge tube 3 in an ionization state, as stated earlier. Moreover, the lower-potential terminal of the multiplying capacitor 9 is coupled to the lower-potential terminal of the main capacitor 2 via the second diode 8.

Attempting to minimize the electrical loss by coupling the lower-potential terminal of the multiplying capacitor 9 directly to e.g., the cathode of the flash discharge tube 3 would disable the above-mentioned rapid charging operation and therefore is undesirable. This is one reason why the structure shown in FIG. 6A includes the transistor 7.

Specifically, the transistor 7 is coupled between the lower-potential terminal of the multiplying capacitor 9 and the cathode of the flash discharge tube 3. The resistors 10 and 11 ensure that the transistor 7 is turned on to close the loop for applying the charged voltage only when the charged voltage of the multiplying capacitor 9 is to be applied across the flash discharge tube 3. Stated otherwise, at any time when the charged voltage of the multiplying capacitor 9 is not to be applied across the flash discharge tube 3, e.g., while the IGBT 5 is OFF (to place the flash discharge tube 3 in an ionization state), the transistor 7 functions to electrically open the connection between the lower-potential terminal of the multiplying capacitor 9 and the cathode of the flash discharge tube 3.

Thus, the structure of FIG. 6A incorporating the transistor 7 realizes the rapid charging of the multiplying capacitor 9 without hardly any functional problems. Moreover, the transistor 7 has a small impedance when turned on so that it results in little electrical loss.

Figure 2:
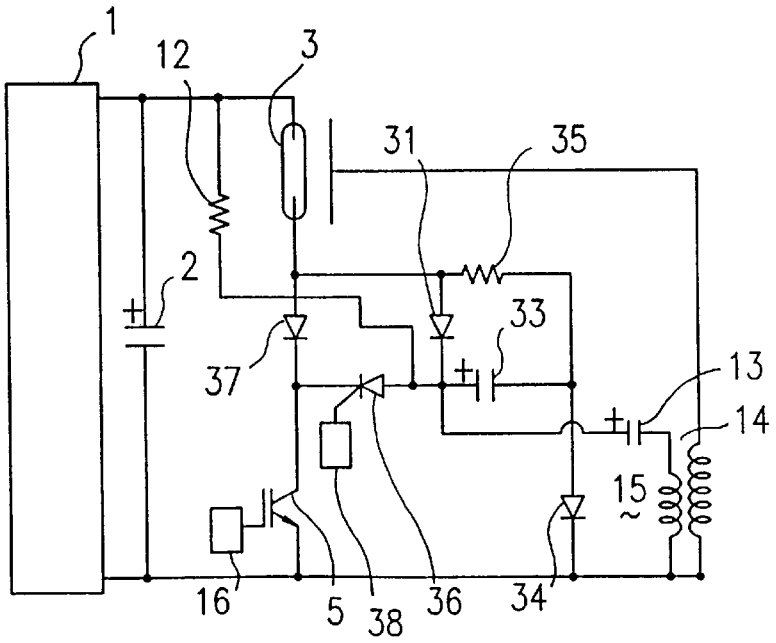
FIG. 2 is a circuit diagram showing an essential portion of a strobe device according to another example of the present invention.

The resistor 6, which is connected in series with the transistor 7, is optional in view of the abovementioned function of the transistor 7, and therefore may be omitted as in FIG. 2 of U.S. Pat. No. 5,180,953. Rather, the resistor 6 Is employed in the structure of FIG. 6A so as to provide protection for the transistor 7. In fact, in an actual device implementing the structure shown in FIG. 6A, the resistance value of the resistor 6 is prescribed at a value which is substantially negligible in terms of electrical loss, e.g., about 22 Ω to about 56 Ω, because the resistor 6 is merely employed as a protection resistor.

However, if the transistor 7 is omitted from the structure of FIG. 6A, an electrical current flows through the flash discharge tube 3 in an ionization state, the resistor 6, and the resistor 8 (for preventing a reverse current) during an OFF state of the IGBT 5. If such a current flows, it becomes impossible to rapidly charge the multiplying capacitor 9, and furthermore, a glow discharge occurs so that the flash discharge tube 3 maintains its ionization state, which may result in the destruction of the resistor 6 and the like in extreme cases.

As will be appreciated from the above, the transistor 7 cannot be simply eliminated from the structure shown in FIG. 6A.

In contrast, the exemplary strobe device shown in FIG. 1 advantageously includes the restriction resistor 35 having a resistance value that satisfies the above-mentioned two conditions so that the two operations of rapidly charging the step-up capacitor 33 (corresponding to the multiplying capacitor 9 in FIG. 6A) and applying the charged voltage across the flash discharge tube 3 are reconciled in spite of the elimination of the transistor 7.

Hereinafter, the operation of the strobe device of the present invention will be described.

When the DC high voltage power supply 1 is activated, the step-up capacitor 33 is charged in the polarity, as shown in FIG. 1, via a charge circuit defined by a combination of the serially connected elements including the flash discharge tube 3 and the diode 31 and a charge path including the resistor 12 and the diode 34, the charge path being coupled in parallel to the serially connected elements.

The charged voltage of the step-up capacitor 33, which is charged so as to provide the higher potential at the terminal coupled to the diode 31, is superimposed on the charged voltage of the main capacitor 2 so as to be applied across the flash discharge tube 3 via a loop including the IGBT 5, the main capacitor 2, and the restriction resistor 35 during the ON state of the IGBT 5, without passing through any switching elements other than the IGBT 5.

As stated in (2) above, the resistance value of the restriction resistor 35 is prescribed so that the voltage across the flash discharge tube 3 is sufficiently stepped up from the charged voltage of the main capacitor 2 alone when the charged voltage of the step-up capacitor 33 is applied across the flash discharge tube 3, so that the stepping-up function (i.e., reducing the discharge starting voltage of the flash discharge tube 3) is sufficiently achieved by the application of the charged voltage of the step-up capacitor 33.

As a result, in the example illustrated in FIG. 1, the application of the charged voltage of the step-up capacitor 33 across the flash discharge tube 3 steps up the voltage across the flash discharge tube 3 to reach a voltage which is about twice as high as the charged voltage of the main capacitor 2. Thus, the flash discharge tube 3 easily starts a luminous operation.

When the IGBT 5 is turned off during the luminous emission of the flash discharge tube 3, the flash discharge tube 3 is left in an ionization state so that a current flows from the main capacitor 2, and the like, through the flash discharge tube 3 in an ionization state, the diode 31, the step-up capacitor 33, and the diode 34. As a result, the step-up capacitor 33 is rapidly charged so that its terminal coupled to the diode 31 takes a higher potential.

Once the rapid charging of the step-up capacitor 33 is finished, the restriction resistor 35 functions to prevent a further current from flowing from the main capacitor 2 and the like through the flash discharge tube 3 in an ionization state, the restriction resistor 35, and the diode 34 because the resistance of the restriction resistor 35 is prescribed at a value such that the electric current flowing through a loop including the flash discharge tube 3, the restriction resistor 35, and the like is controlled at a level such that the flash discharge tube 3 cannot continue to discharge or maintain the ionization state in the structure shown in FIG. 1.

As a result, the exemplary strobe device of the present invention illustrated in FIG. 1 achieves the rapid charging of the step-up capacitor 33 and the application of a voltage across the flash discharge tube 3 which is higher than the charged voltage of the main capacitor 2 without fail, while eliminating the transistor 7 and the like from the conventional structure illustrated in FIG. 6A, i.e., with substantially fewer component elements.

Next, an experiment conducted for determining the resistance value of the restriction resistor 35 according to the example illustrated in FIG. 1 will be described.

The experiment was performed by using strobe devices incorporating the flash discharge tube 3 having a tube diameter of 2.5 mm with the electrodes being located 20 mm apart at both ends and the restriction resistor 35 having various resistance values. The strobe devices were caused to perform 10 full emissions at an interval of 30 seconds.

Furthermore, a first experiment was conducted where the charged voltage of the main capacitor 2 was increased by 5 V every time there was even a single emission failure during the above-mentioned repetitious luminous operations so as to determine a flashing voltage that ensured luminous operations without failure. A second experiment was conducted to confirm whether or not the ionization state of the flash discharge tube 3 was maintained during the above-mentioned repetitious luminous operations. For reference, a strobe device lacking a step-up circuit was caused to perform 10 full emissions at ah interval of 30 seconds, which indicated that it required a flashing voltage of 350 V for performing luminous operations without failure.

TABLE 1

| Resistance value of restriction resistor 35 | Flashing voltage | Difference |
|---|---|---|
| 100 Ω | 230 V | −120 V |
| 1.0 kΩ | 230 V | −120 V |
| 1.8 kΩ | 230 V | −120 V |
| 2.0 kΩ | 230 V | −120 V |
| 3.3 kΩ | 235 V | −115 V |
| 4.7 kΩ | 240 V | −110 V |
| 6.8 kΩ | 250 V | −100 V |
| 10.0 kΩ | 260 V | −90 V |

Table 1 shows the results of the first experiment.

As seen from Table 1, the flashing voltage increases as the resistance value of the resistor 35 increases. That is, the resistance of the resistor 35 impairs the stepping-up function as the value increases.

Specifically, in the case where the resistance value of the restriction resistor 35 is 2.0 kΩ, a flash occurs at a flashing voltage of 230 V, which is 120 V lower than 350 V, i.e., the flashing voltage in the case where no step-up circuit is employed. However, in the case where the resistance value of the restriction resistor 35 is 10.0 kΩ, a flash occurs at a flashing voltage of 260 V, which is only 90 V lower than the flashing voltage of a strobe device lacking a step-up circuit. Although not shown in Table 1, it has been confirmed that, as the resistance value of the restriction resistor 35 is further increased, the flashing voltage drastically increases to approach 350 V.

As for the lowering effect of the flashing voltage in terms of an aid for the discharge starting operation of the flash discharge tube 3, it has been confirmed that a substantial step-up effect is obtained if the flashing voltage can be lowered to at least about ¾ (e.g., 350 V×¾=262.5 V) of the flashing voltage of a strobe device lacking a step-up circuit. Herein, it is contemplated that a "substantial step-up effect" is obtained where the strobe device becomes capable of supporting repetitious luminous operations occurring at such a high-frequency that it cannot be attained with a flashing voltage of 350 V. Thus, the restriction resistor 35 in the strobe device shown in FIG. 1 has an upper limit of about 10 kΩ.

Table 2 shows the results of the second experiment.

TABLE 2

| Resistance value of restriction resistor 35 | Glow discharge |
|---|---|
| 100 Ω | occurred |
| 1.0 kΩ | occurred |
| 1.8 kΩ | occurred |
| 2.0 kΩ | not occurred |
| 3.3 kΩ | not occurred |
| 4.7 kΩ | not occurred |
| 6.8 kΩ | not occurred |
| 10.0 kΩ | not occurred |

As seen from Table 2, the flash discharge tube 3 enters a glow discharge state (where the flash discharge tube 3 maintains an ionization state) as the resistor 35 reaches a certain resistance value (discussed below). In other words, while being bound by the above-discussed upper limit in view of reduction of the flashing voltage, the resistance value of the restriction resistor 35 also has a lower limit, past which the unwanted glow discharge occurs.

Specifically, in the second experiment, a glow discharge occurred when the resistance value of the restriction resistor 35 was 1.8 kΩ or less, whereas no glow discharge was observed when the value was 2.0 kΩ. Thus, the restriction resistor 35 in the strobe device of FIG. 1 has a lower limit of 2.0 kΩ.

Thus, the specific range of resistance values of the restriction resistor 35 in the strobe device of FIG. 1 has been confirmed through the above-described experiment.

FIG. 2 is a circuit diagram showing an essential portion of a strobe device according to another example of the present invention. As seen from FIG. 2, a control switch element 36 is coupled between the diode 31 and the IGBT 5 in addition to the exemplary structure shown in FIG. 1. Moreover, a control diode 37 is connected in parallel to serially connected elements including the control switch element 36 and the diode 31. Reference numeral 38 denotes a driving circuit for turning the control switch element 36 on or off.

Thus, the exemplary strobe device shown in FIG. 2 having the above structure achieves, as does the strobe device shown in FIG. 1, the rapid charging of the step-up capacitor 33 and the application of a voltage across the flash discharge tube 3 which is higher than the charged voltage of the main capacitor 2 without fail in a luminous operation. Furthermore, the operation of the IGBT 5 can be controlled independently of the other operations.

The exemplary strobe device shown in FIG. 2 can be configured so that the IGBT 5 is turned on at, or before, the start of the luminous operation of the flash discharge tube 3 based on the timing relationship of activation of the control switch element 36. In other words, more liberty for the control operation of the IGBT 5 is provided. For example, in an actual luminous operation of the flash discharge tube 3, the IGBT 5 can be turned on before the control switch element 36 is turned on. Thus, the luminous operation can be performed free from any unfavorable influence of the capacitance component of the IGBT 5, as described below:

It is known that, when a drive voltage is supplied to the gate of the IGBT 5, the IGBT 5 enters a complete ON state only after a capacitance component present between the gate and the emitter, etc, thereof is charged. Therefore, in the exemplary strobe device shown in FIG. 1, where the discharge operation of the trigger capacitor 13 and the step-up capacitor 33 is controlled by the activation of the IGBT 5, the discharge operation may be started although the IGBT 5 has not entered a complete ON state and therefore is still in a high impedance state. This may hinder the desired trigger operation or step-up operation.

Specifically, under the above conditions, a sufficient trigger output may not be supplied to the flash discharge tube 3 or the charged voltage of the step-up capacitor 33 may not be fully supplied so that the flash discharge tube 3 may fail to flash. Even if the flash discharge tube 3 does flash, a large current may flow from the main capacitor 2 through the flash discharge tube 3 into the IGBT 5, which is still in a high impedance state, so that the IGBT 5 may be destroyed in very extreme cases.

On the other hand, in the exemplary strobe device shown in FIG. 2 including the control switch element 36, the IGBT 5 can be turned on before the control switch element 36 is turned on. As a result, the trigger capacitor 13 and the step-up capacitor 33 can be discharged without any influence of the capacitance component of the IGBT 5. In other words, both discharge operations can be performed via the IGBT 5 in a complete ON state (indicative of a low impedance), whereby flashing failures can be prevented.

Figure 3:
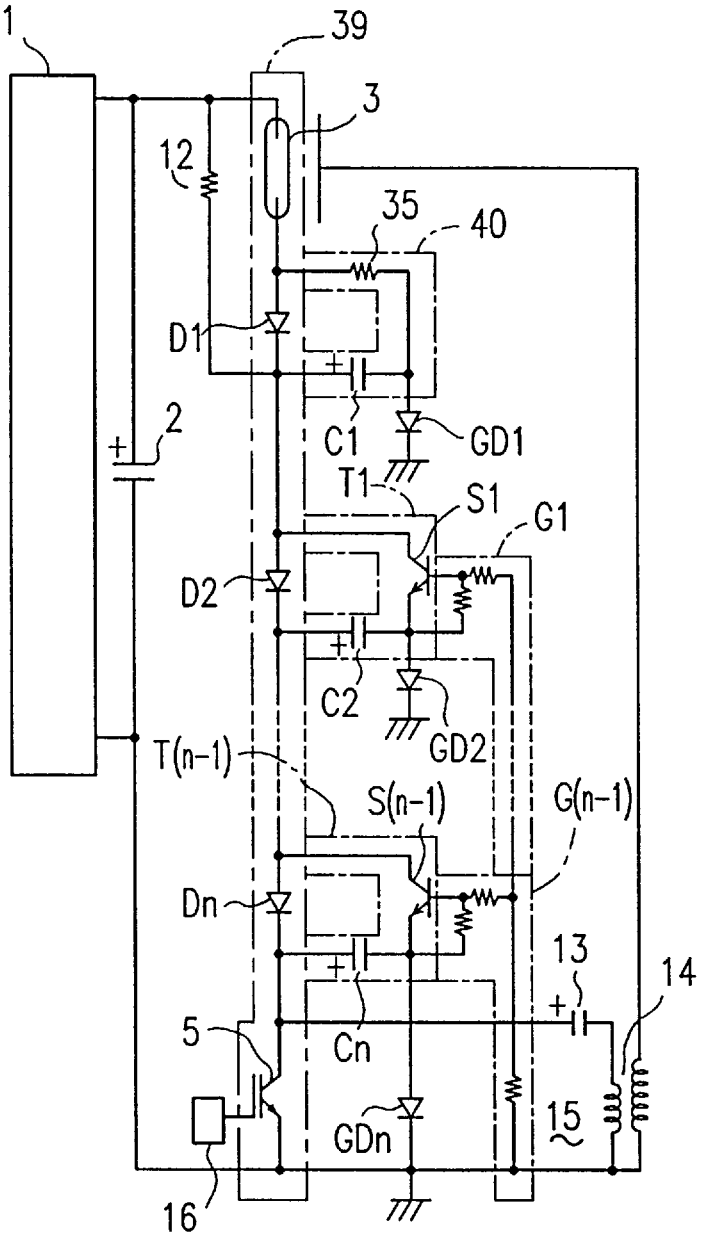
FIG. 3 is a circuit diagram showing an essential portion of a strobe device according to still another example of the present invention.

FIG. 3 is a circuit diagram showing an essential portion of a strobe device according to still another example of the present invention.

As described above, in the exemplary strobe devices shown in FIGS. 1 and 2, a voltage which is twice as high as the charged voltage of the main capacitor 2 is applied across the flash discharge tube 3. Now, in accordance with the strobe device of FIG. 3, a voltage which is equal to or more than three times the charged voltage of the main capacitor 2 (as in the conventional structure illustrated in FIG. 5B) is applied across the flash discharge tube 3. In FIG. 3, constituent elements which also appear in FIG. 1, etc. are indicated by like numerals.

In FIG. 3, reference numeral 39 collectively refers to first serially connected elements, which include a flash discharge tube 3, a plurality of diodes D1, D2, . . . , Dn, and an IGBT 5 connected in series with one another. The first serially connected elements are connected across a main capacitor 2. Reference numeral 40 collectively refers to third serially connected elements, which include a first step-up capacitor C1 and a restriction resistor 35 connected In series with each other. The third serially connected elements are connected across the diode D1. As shown in FIG. 3, the anode of the diode D1 is coupled to the cathode of the flash discharge tube 3.

Reference numerals T1 to T(n−1) collectively refer to a set of serially connected elements, each set of serially connected elements including one of a plurality of switch elements (e.g., transistors) S1 to S(n−1) and one of a plurality of second step-up capacitors C2 to Cn connected in series with each other. Each serially connected element is connected across the anode and the cathode of a corresponding one of the plurality of diodes D2 to Dn (note that the diode D1 is excluded). Reference numerals GD1 to GDn represent a plurality of diodes for preventing reverse currents. The diode GD1 is coupled between the collector of the IGBT 5 and a junction between the first step-up capacitor C1 and the restriction resistor 35 of the third serially connected elements 40; the diodes GD2 to GDn are coupled between the emitter of the IGBT 5 and the respective junctions between the switch elements S1 to S(n−1) and the second step-up capacitors C2 to Cn of the serially connected elements T1 to T(n−1).

Reference numerals G1 to G(n−1) refer to gate circuits coupled to the respective control terminals (e.g., bases in the case of transistors) of the switch elements S1 to S(n−1).

In accordance with the above-described exemplary strobe device of the present invention shown in FIG. 3, when the DC high voltage power supply 1 is activated, the first and second step-up capacitors C1 to Cn are charged so as to have the polarities as shown in FIG. 3 via a charge circuit including a resistor 12.

When the IGBT 5 is in an ON state, as the switch elements S1 to S(n−1) are turned on due to the function of the gate circuits G1 to G(n−1), the charged voltages of the first and second step-up capacitors C1 to Cn are superimposed upon one another via the IGBT 5, the main capacitor 2, the restriction resistor 35 and the switch elements S1 to S(n−1), so as to be further superimposed on the charged voltage of the main capacitor 2, and then applied across the flash discharge tube 3.

The resistance value of the restriction resistor 35 is prescribed at a value which does not undermine the step-up function due to the application of the charged voltages of the first and second step-up capacitors C1 to Cn, as discussed above. As a result, in the exemplary strobe device shown in FIG. 3, the potential difference across the flash discharge tube 3 is increased to a voltage which is about (n+1) times as high as the charged voltage of the main capacitor 2 due to the application of the charged voltages of the first and second step-up capacitors C1 to Cn. Thus, the flash discharge tube 3 easily starts a luminous operation.

On the other hand, when the IGBT 5 is turned off during the luminous emission of the flash discharge tube 3, the flash discharge tube 3 is left in an ionization state so that a current flows from the main capacitor 2 and the like through the flash discharge tube 3 in an ionization state, the diodes D1 to Dn, the first and second step-up capacitors C1 to Cn, and the reverse current-prevention diodes GD1 to GDn. As a result, the first and second step-up capacitors C1 to Cn are rapidly charged.

Once the rapid charging of the first and second step-up capacitors C1 to Cn is finished, the restriction resistor 35 functions to prevent a further current from flowing through the flash discharge tube 3 in an ionization state, the restriction resistor 35, and the diode GD1 because the resistance of the restriction resistor 35 is prescribed at a value such that the electric current flowing through a loop including the flash discharge tube 3, the restriction resistor 35, and the like is controlled at a level such that the flash discharge tube 3 cannot continue to maintain the ionization state in the structure shown in FIG. 3.

Figure 6B:
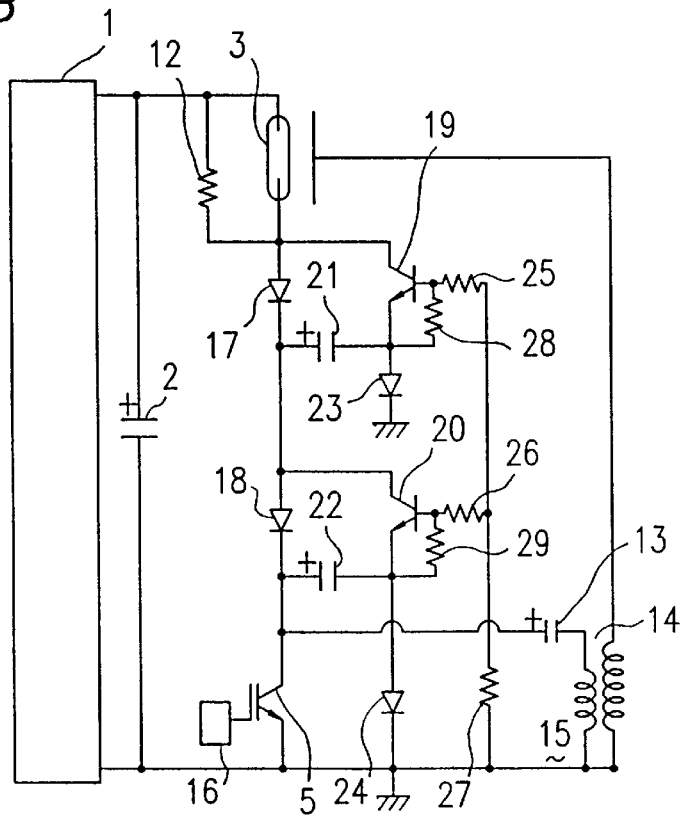
PRIOR ART FIG. 6B
FIG. 6B is a circuit diagram showing an essential portion of a conventional strobe device disclosed in U.S. Pat. No. 5,180,953.

As a result, the exemplary strobe device of the present invention illustrated in FIG. 3 achieves the rapid charging of the first and second step-up capacitors C1 to Cn and the application of a voltage across the flash discharge tube 3 which is about (n+1) times as high as the charged voltage of the main capacitor 2 without fail, while eliminating the transistor 19 and the like from the conventional structure illustrated in FIG. 6B, i.e., with substantially fewer component elements.

Figure 4:
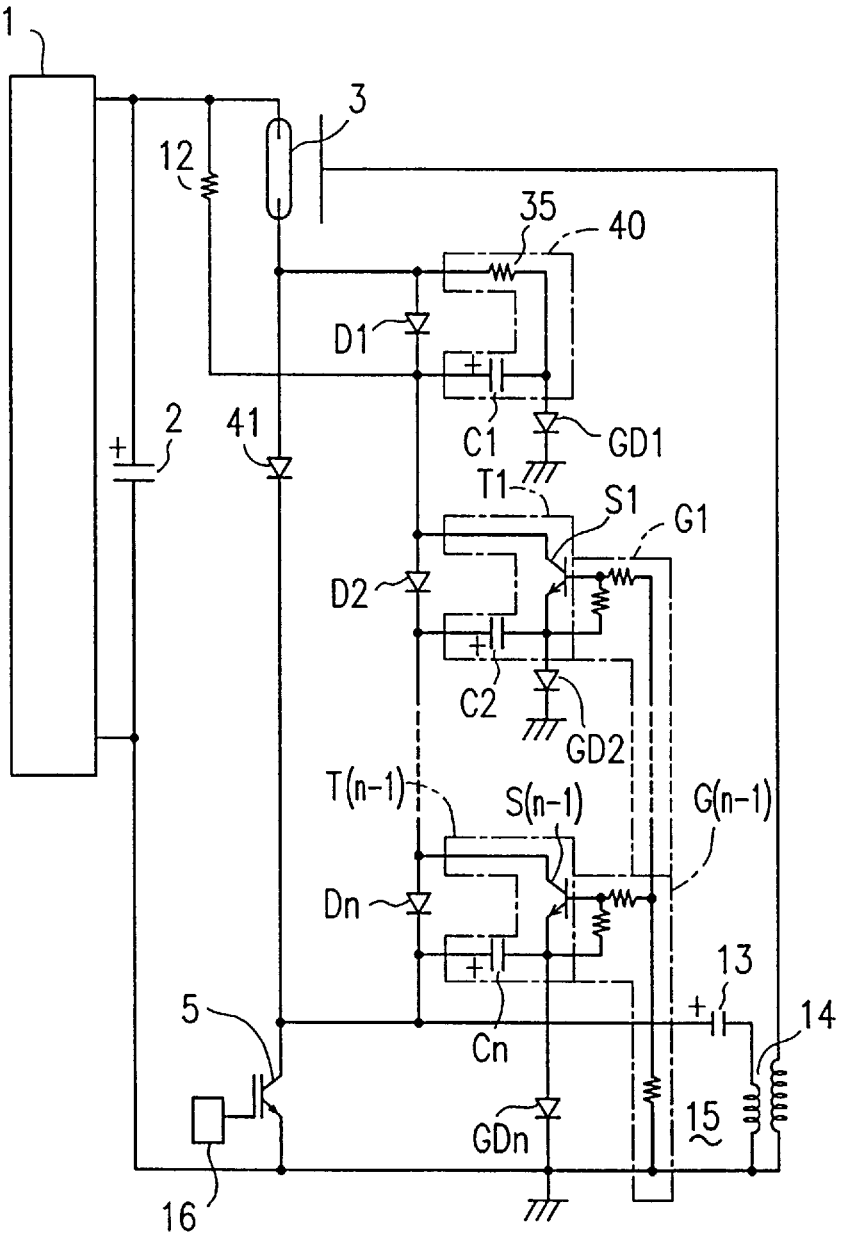
FIG. 4 is a circuit diagram showing an essential portion of a strobe device according to still another example of the present invention.

FIG. 4 is a circuit diagram showing an essential portion of a strobe device according to still another example of the present invention. This strobe device further includes a control diode 41, connected in parallel to the serially connected elements including a plurality of diodes D1 to Dn, in addition to the elements in the exemplary strobe device shown in FIG. 3.

In accordance with the exemplary strobe device shown in FIG. 4 having the above-mentioned structure, the discharge operation of the main capacitor 2 during a luminous operation of the flash discharge tube 3 occurs via the control diode 41. Otherwise the operation of the strobe device of the present example is the same as that of the exemplary strobe device illustrated in FIG. 3 (e.g., charging and discharging of the first and second step-up capacitors C1 to Cn).

As a result, the exemplary strobe device of the present invention illustrated in FIG. 4 achieves the rapid charging of the first and second step-up capacitors C1 to Cn and the application of a voltage across the flash discharge tube 3 which is about (n+1) times as high as the charged voltage of the main capacitor 2 without fail, with a relatively small number of component elements. In addition, the number of the diodes within the discharge loop of the main capacitor 2 can be reduced as compared with the exemplary strobe device illustrated in FIG. 3, thereby providing a further advantage in terms of utilization efficiency of the charged energy of the main capacitor 2.

Figure 5:
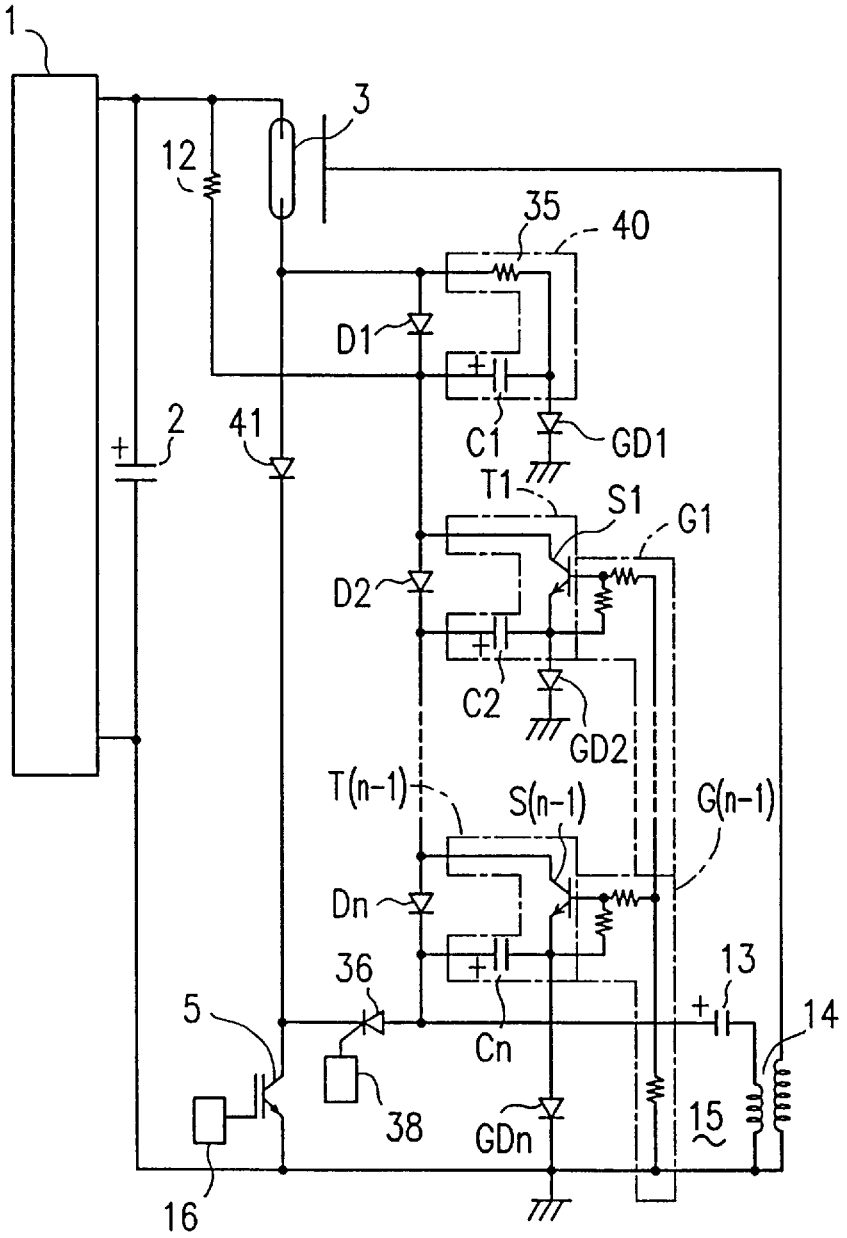
FIG. 5 is a circuit diagram showing an essential portion of a strobe device according to still another example of the present invention.

FIG. 5 is a circuit diagram showing an essential portion of a strobe device according to still another example of the present invention. In addition to the elements in the exemplary strobe device shown in FIG. 4, this strobe device further includes a control switch element 36 illustrated with respect to the exemplary strobe device shown in FIG. 2, the control switch element 36 being coupled between a plurality of diodes D1 to Dn and the IGBT 5. A driving circuit 38 is coupled to the control switch element 36 for turning the control switch element 36 on or off.

In accordance with the above-mentioned structure, the exemplary strobe device shown in FIG. 5 achieves the rapid charging of the first and second step-up capacitors C1 to Cn and the application of a voltage across the flash discharge tube 3 which is about (n+1) times as high as the charged voltage of the main capacitor 2 without fail, with a relatively small number of component elements, as in the examples illustrated with reference to FIGS. 2 and 4. In addition, a further advantage is provided in terms of utilization efficiency of the charged energy of the main capacitor 2. Moreover, the strobe device shown in FIG. 5 can be configured so that the IGBT 5 is turned on at, or before, the start of the luminous operation of the flash discharge tube 3. In other words, more liberty for the control operation of the IGBT 5 is provided. For example, in an actual luminous operation of the flash discharge tube 3, the IGBT 5 can be turned on before the control switch element 36 is turned on. Thus, the luminous operation can be performed free from any unfavorable influence of the capacitance component of the IGBT 5.

As described above, according to the present invention, a strobe device is provided which includes a steplup means including at least one step-up capacitor which is rapidly charged via a flash discharge tube in an ionization state such that the charged voltage of the at least one step-up capacitor is superimposed on the charged voltage of the main capacitor at least via an IGBT and a restriction resistor connected in series with the flash discharge tube, the resultant superimposed voltage being applied across the flash discharge tube. Thus, a step-up circuit structure, which is capable of rapidly charging, is realized with a relatively small number of elements, thereby requiring a small space. As a result, the strobe device according to the present invention can be miniaturized, and produced with a low cost.

Various other modifications will be apparent to and can be readily made by those skilled in the art without departing from the scope and spirit of this invention. Accordingly, it is not intended that the scope of the claims appended hereto be limited to the description as set forth herein, but rather that the claims be broadly construed.

What is claimed is:

1. A strobe device comprising:

a main capacitor; and step-up means including at least one step-up capacitor, the at least one step-up capacitor being rapidly charged via a flash discharge tube in an ionization state, a charged voltage of the at least one step-up capacitor being superimposed on a charged voltage of the main capacitor and applied across the flash discharge tube at least via an insulated gate bipolar transistor and a restriction resistor coupled in series with the flash discharge tube, wherein the resistance value of the restriction resistor is prescribed to satisfy both of the following two conditions:

(1) during an OFF state of the insulated gate bipolar transistor, an electric current flowing via the flash discharge tube is controlled at a level where the flash discharge tube cannot continue to discharge; and (2) during an ON state of the insulated gate bipolar transistor, a voltage across the flash discharge tube is stepped up to a voltage which is higher than the charged voltage of the main capacitor when the charged voltage of the step-up capacitor is applied across the flash discharge tube.

2. A strobe device according to claim 1, wherein a charged voltage of the at least one step-up capacitor is superimposed on the charged voltage of the main capacitor and applied across the flash discharge tube via no other switch element than the insulated gate bipolar transistor.

3. A strobe device according to claim 1, wherein a charged voltage of the at least one step-up capacitor is superimposed on the charged voltage of the main capacitor and applied across the flash discharge tube via a control switch element as well as the insulated gate bipolar transistor and the restriction resistor.

4. A strobe device according to claim 1, wherein the step-up means includes n step-up capacitors (where n is an integer), charged voltages of the n step-up capacitors being superimposed on the charged voltage of the main capacitor and applied across the flash discharge tube via (n−1) control switch elements as well as the insulated gate bipolar transistor and the restriction resistor, each of the (n−1) control switch elements being provided in a loop dedicated for the application of the charged voltages across the flash discharge tube.

5. A strobe device comprising:

a main capacitor;

first serially connected elements including a flash discharge tube, a diode, and an insulated gate bipolar transistor connected in series with one another, the first serially connected elements being coupled across the main capacitor, a luminous operation of the flash discharge tube being controlled responsive to the turning on and off of the insulated gate bipolar transistor, and an anode of the diode being coupled to a cathode of the flash discharge tube; and step-up means including:

second serially connected elements including a step-up capacitor and a reverse current-prevention diode connected in series with one another, the second serially connected elements being coupled across the insulated gate bipolar transistor;

a restriction resistor having one end coupled to the anode of the diode and another end coupled to a junction between the step-up capacitor and the reverse current-prevention diode, whereby the restriction resistor being coupled to the cathode of the diode via the step-up capacitor; and a charge path coupled in parallel to serially connected elements including the flash discharge tube and the diode, the charge path and the reverse current-prevention diode forming a charge circuit for charging the step-up capacitor so that a higher potential is provided at an end of the step-up capacitor coupled to the diode, wherein the resistance value of the restriction resistor is prescribed to satisfy both of the following two conditions:

(1) during an OFF state of the insulated gate bipolar transistor for stopping the luminous operation of the flash discharge tube, an electric current flowing in a loop including the flash discharge tube, the restriction resistor, and the reverse current-prevention diode is controlled at a level where the flash discharge tube cannot continue to discharge; and (2) during an ON state of the insulated gate bipolar transistor, a voltage across the flash discharge tube is stepped up to a voltage which is higher than the charged voltage of the main capacitor when the charged voltage of the step-up capacitor is applied across the flash discharge tube, whereby the step-up means rapidly charges the step-up capacitor via the flash discharge tube in an ionization state and the reverse current-prevention diode, and applies the charged voltage of the step-up capacitor across the flash discharge tube via the restriction resistor.

6. A strobe device according to claim 5, wherein the step-up means includes: a control element coupled between the diode and the insulated gate bipolar transistor; and a control diode coupled in parallel to serially connected elements including the diode and the control element.

7. A strobe device comprising:

a main capacitor;

first serially connected elements including a flash discharge tube, a plurality of diodes, and an insulated gate bipolar transistor connected in series with one another, the first serially connected elements being coupled across the main capacitor, a luminous operation of the flash discharge tube being controlled responsive to the turning on and off of the insulated gate bipolar transistor, an anode of a first one of the plurality of diode being coupled to a cathode of the flash discharge tube; and step-up means including:

third serially connected elements including a restriction resistor and a first step-up capacitor connected in series with each other, the restriction resistor having one end coupled to the anode of the first one of the plurality of diode and another end coupled to a cathode of the first one of the plurality of diodes via the step-up capacitor;

at least one series of serially connected elements including a switch element and a second step-up capacitor, the switch element being coupled between an anode and a cathode of each one of the plurality of diodes except the first one of the plurality of diodes;

a plurality of reverse current-prevention diodes, one of the plurality of reverse current-prevention diodes being coupled between an emitter of the insulated gate bipolar transistor and a junction between the first step-up capacitor and the restriction resistor, and the others of the plurality of reverse current-prevention diodes being coupled between the emitter of the insulated gate bipolar transistor and respective junctions between the switch elements and the second step-up capacitors of the at least one series of serially connected elements;

a gate circuit coupled to a control terminal of each switch element coupled to the second step-up capacitor; and a charge path coupled in parallel to serially connected elements including the flash discharge tube and the first one of the plurality of diodes, the charge path and the plurality of reverse current-prevention diodes forming a charge circuit for charging the first and second step-up capacitors so that a higher potential is provided at an end of each of the first and second step-up capacitors coupled to a corresponding one of the plurality of diodes, wherein the resistance value of the restriction resistor is prescribed to satisfy both of the following two conditions:

(1) during an OFF state of the insulated gate bipolar transistor for stopping the luminous operation of the flash discharge tube, an electric current flowing in a loop including the flash discharge tube, the restriction resistor, and the plurality of reverse current-prevention diodes is controlled at a level where the flash discharge tube cannot continue to discharge; and (2) during an ON state of the insulated gate bipolar transistor, a voltage across the flash discharge tube is stepped up to a voltage which is higher than the charged voltage of the main capacitor when the charged voltages of the first and second step-up capacitors are applied across the flash discharge tube, whereby the step-up means rapidly charges the first and second step-up capacitors via the flash discharge tube in an ionization state and the plurality of reverse current-prevention diodes, and applies the charged voltages of the first and second step-up capacitors across the flash discharge tube via the restriction resistor and the switch elements.

8. A strobe device according to claim 7, wherein the step-up means further includes a control diode coupled in parallel to serially connected elements including the plurality of diodes each coupled between the flash discharge tube and the insulated gate bipolar transistor.

9. A strobe device according to claim 7, wherein the step-up means further includes: a control switch element coupled between serially connected elements including the plurality of diodes and the insulated gate bipolar transistor; and a control diode coupled in parallel to serially connected elements including the plurality of diodes and the control switch element.

* * * * *